US012674405B2

(12) United States Patent
Kai

(10) Patent No.: US 12,674,405 B2
(45) Date of Patent: Jul. 7, 2026

(54) ENGINE

(71) Applicant: TOYOTA JIDOSHA KABUSHIKI KAISHA, Toyota (JP)

(72) Inventor: Naoko Kai, Okazaki (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 19/093,307

(22) Filed: Mar. 28, 2025

(65) Prior Publication Data

US 2025/0347237 A1 Nov. 13, 2025

(30) Foreign Application Priority Data

May 9, 2024 (JP) ..... 2024-076547

(51) Int. Cl.
*F01M 13/02* (2006.01)
*F01M 13/00* (2006.01)
*F01M 13/04* (2006.01)

(52) U.S. Cl.
CPC ..... *F01M 13/028* (2013.01); *F01M 13/0011* (2013.01); *F01M 13/04* (2013.01)

(58) Field of Classification Search
CPC ... F01M 13/028; F01M 13/0011; F01M 13/04
USPC ..... 123/574
See application file for complete search history.

(56) References Cited

U.S. PATENT DOCUMENTS 4,674,457 A * 6/1987 Berger ..... F01M 11/0004 123/196 R
2008/0110443 A1* 5/2008 Hirano ..... F01M 13/021 123/572
2020/0263576 A1* 8/2020 Grois ..... F01M 13/0011

FOREIGN PATENT DOCUMENTS

JP 2011-185181 A 9/2011

* cited by examiner

*Primary Examiner* — Yi-Kai Wang

(57) ABSTRACT

In an engine that ventilates a crankcase by introducing air from an opening through a one-way valve, a shielding plate is set proximate to the opening inside the crankcase. The shielding plate includes a dividing wall located upward from a liquid surface of engine oil and downward from the opening.

4 Claims, 4 Drawing Sheets

ENGINE

CROSS-REFERENCE TO RELATED APPLICATIONS

This application is based upon and claims the benefit of priority from Japanese Patent Application No. 2024-076547, filed on May 9, 2024, the entire contents of which are incorporated herein by reference.

BACKGROUND

1. Field

The following description relates to an engine that performs ventilation of a crankcase.

2. Description of Related Art

Japanese Laid-Open Patent Publication No. 2011-185181 discloses an engine including a ventilation system that vents blow-by gas from a crankcase by introducing air from an intake passage into the crankcase.

Engine oil is stored inside the crankcase. Accordingly, when air is introduced into the crankcase for ventilation, blowing of the introduced air may stir the engine oil. If the engine oil is stirred, air bubbles may be mixed into the engine oil and form an emulsion. In addition, the engine oil is easily atomized into a mist by stirring. Some of the oil mist is carried away from the crankcase together with the blow-by gas. Thus, the introduction of air into the crankcase for ventilation may increase engine oil consumption.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, an engine is provided. The engine includes an intake passage, a crankcase, an air introduction passage, and a shielding plate. The crankcase accommodates a crankshaft and includes an oil pan that stores engine oil. The air introduction passage connects the intake passage and an inside of the crankcase. The shielding plate is set proximate to an opening of the air introduction passage to the inside of the crankcase. The shielding plate includes a dividing wall that is located upward from a liquid surface of the engine oil and downward from the opening in a state in which the engine is mounted on a vehicle. The engine is configured to perform ventilation of the crankcase by introducing air from the intake passage through the air introduction passage.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

Hereinafter, an embodiment of an engine will be described in detail with reference to FIGS. 1 to 4.

Configuration of Engine 10

Figure 1:
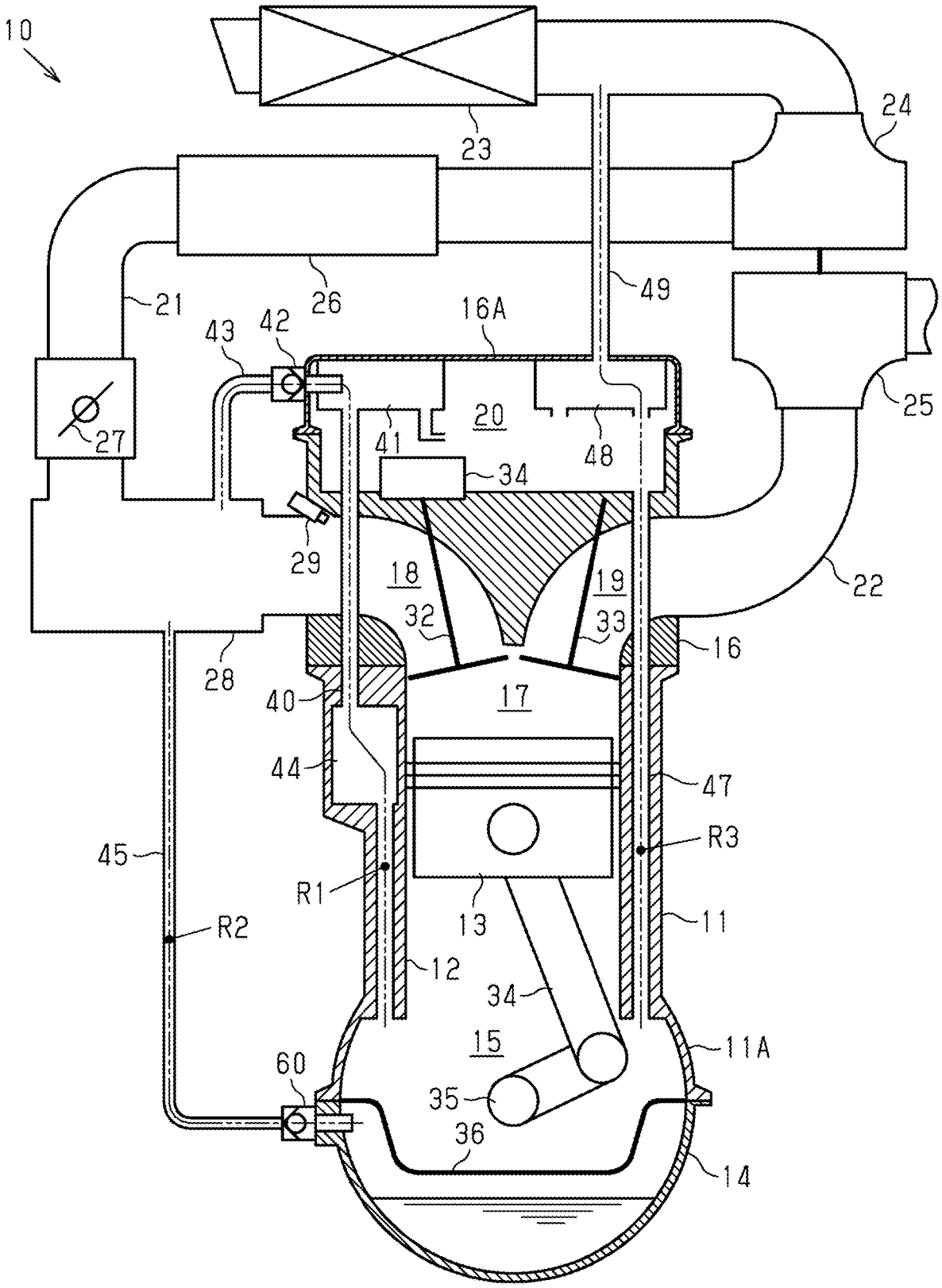
FIG. 1 is a diagram schematically showing the structure of an engine in accordance with an embodiment.

First, the configuration of the engine 10 will be described with reference to FIG. 1. The engine 10 shown in FIG. 1 is a hydrogen engine that generates power by burning hydrogen. In the case of a hydrogen engine, combustible hydrogen may be contained in the blow-by gas. For this reason, hydrogen engines are required to have higher ventilation performance for blow-by gas than gasoline engines and diesel engines.

The engine 10 includes a cylinder block 11. Cylinders 12 are formed inside the cylinder block 11. FIG. 1 shows only one of the cylinders 12. A piston 13 is accommodated in each of the cylinders 12 so as to be able to reciprocate. A combustion chamber 17 for burning hydrogen is formed in a portion of the cylinder 12 above the piston 13. The piston 13 is coupled to a crankshaft 35 via a connecting rod 34.

A cylinder head 16 is mounted on the upper part of the cylinder block 11. Inside the cylinder head 16, an intake port 18 and an exhaust port 19 are formed for each cylinder 12. A head cover 16A is mounted on the upper side of the cylinder head 16. A valve operating chamber 20 that houses a valvetrain is formed inside the upper part of the cylinder head 16, covered by the head cover 16A.

An oil pan 14 for storing engine oil is attached to a lower portion of the cylinder block 11. A crankcase 15 that houses the crankshaft 35 is defined by a portion of the interior of the cylinder block 11 below the cylinders 12 and the oil pan 14. Inside the crankcase 15, a baffle plate 36 is provided to prevent engine oil from scattering to the crankshaft 35, its bearings, and the like. Inside the crankcase 15, the baffle plate 36 is interposed between the engine oil in the oil pan 14 and the crankshaft 35.

The engine 10 includes an intake passage 21, through which air is drawn into the combustion chamber 17, and an exhaust passage 22, through which exhaust gas is discharged from the combustion chamber 17. The intake passage 21 includes an air cleaner 23 that filters dust or the like from the air. The portion of intake passage 21 downstream of the air cleaner 23 includes a compressor 24. The compressor 24 constitutes a turbocharger together with a turbine 25 installed in the exhaust passage 22. The portion of the intake passage 21 downstream of the compressor 24 includes an intercooler 26. The intercooler 26 is a heat exchanger for cooling the air heated to a high temperature by the compression in the compressor 24. A throttle valve 27 is disposed in the intake passage 21 downstream of the intercooler 26. The throttle valve 27 is a valve for adjusting the flow rate of air sent to the combustion chamber 17 through the intake passage 21. The intake passage 21 branches for each cylinder 12 in an intake manifold 28 that is located downstream of the throttle valve 27. The intake manifold 28 is connected to the combustion chamber 17 through the intake port 18.

The engine 10 is provided with an injector 29 for injecting hydrogen into air used for combustion in the combustion chamber 17. In FIG. 1, the injector 29 is disposed to inject hydrogen into the intake port 18. Instead, the injector 29 may be disposed to inject hydrogen into the combustion chamber 17. The engine 10 further includes an intake valve 32 that opens and closes the intake port 18 with respect to the combustion chamber 17, and an exhaust valve 33 that opens and closes the exhaust port 19 with respect to the combustion chamber 17.

Ventilation System

The engine 10 includes a ventilation system for the crankcase 15. The ventilating system is provided with three passages of a first passage R1, a second passage R2, and a third passage R3 as passages for communicating the intake passage 21 with the crankcase 15.

The first passage R1 communicates a portion of the intake passage 21 downstream of the throttle valve 27 with the crankcase 15. The first passage R1 is constituted by the blow-by gas passage 40, the first separators 41, the PCV valve 42, the first PCV hose 43, and the second separators 44. The first and second separators 41 and 44 are separators that separate oil mist from the blow-by gas flowing through the first passage R1. The first separator 41 is mounted on the inner side of the head cover 16A. The blow-by gas passage 40 is a passage that passes through the inside of the cylinder block 11 and the cylinder head 16 and connects the crankcase 15 and the first separator 41. The second separator 44 is provided in an intermediate portion of the blow-by gas passage 40 in the cylinder block 11. The first PCV hose 43 is a hose that connects the first separator 41 and the intake manifold 28. The PCV valves 42 allow the flow of gas from the inside of the crankcase 15 to the intake passage 21 through the first passage R1, and restrict the flow of gas from the intake passage 21 to the inside of the crankcase 15 through the first passage R1. The PCV valve 42 is installed at a connection portion of the first PCV hose 43 to the first separator 41.

The second passage R2 communicates a portion of the intake passage 21 downstream of the compressor 24 with the crankcase 15. In the case of FIG. 1, the second passage R2 is configured to communicate between the intake manifold 28 and the crankcase 15. The second passage R2 is constituted by the second PCV hose 45 and the one-way valve 60. The second PCV hose 45 is a hose that connects the crankcase 15 and the intake manifold 28. The one-way valve 60 allows the flow of air from the intake passage 21 to the crankcase 15 through the second passage R2, and restricts the flow of gas from the crankcase 15 to the intake passage 21 through the second passage R2. In the case of the engine 10 of the present embodiment, the second passage R2 corresponds to an air introduction passage through which the intake passage 21 communicates with the inside of the crankcase 15. In the engine 10 of the present embodiment, the one-way valve 60 is attached to the crankcase 15. The attachment structure of the one-way valve 60 to the crankcase 15 will be described in detail later.

The third passage R3 communicates a portion of the intake passage 21 upstream of the compressor 24 with the crankcase 15. The third passage R3 is constituted by the oil return passage 47, the valve operating chamber 20, the third separator 48, and the third PCV hose 49. The oil return passage 47 is a passage that passes through the inside of the cylinder block 11 and the cylinder head 16 to communicate the valve operating chamber 20 with the crankcase 15. The oil return passage 47 functions as a passage for returning oil from the valve operating chamber 20 to the oil pan 14, and also functions as a passage for circulating gas between the valve operating chamber 20 and the crankcase 15. The third separators 48 are separators that separate oil mist in the blow-by gas flowing through the third passage R3. The third separator 48 is disposed on the inner side of the head cover 16A. The third PCV hose 49 is a hose that connects a portion of the intake passage 21 downstream of the air cleaner 23 and upstream of the compressor 24 to the third separator 48.

During the natural aspiration operation of the engine 10, a portion of the intake passage 21 downstream of the throttle valve 27 has a negative pressure. Due to this negative pressure, the blow-by gas in the crankcase 15 is sucked into the intake passage 21 through the first passage R1. In addition, air is introduced into the crankcase 15 through the third passage R3. On the other hand, during the supercharging operation of the engine 10, a portion of the intake passage 21 downstream of the compressor 24 has a positive pressure. At this time, the air having a positive pressure is introduced into the crankcase 15 from the intake passage 21 through the second passage R2. Then, the blow-by gas in the crankcase 15 is pushed out by the introduced air and is discharged to the intake passage 21 through the third passage R3.

Attachment Structure for One-Way Valve 60

Figure 2:
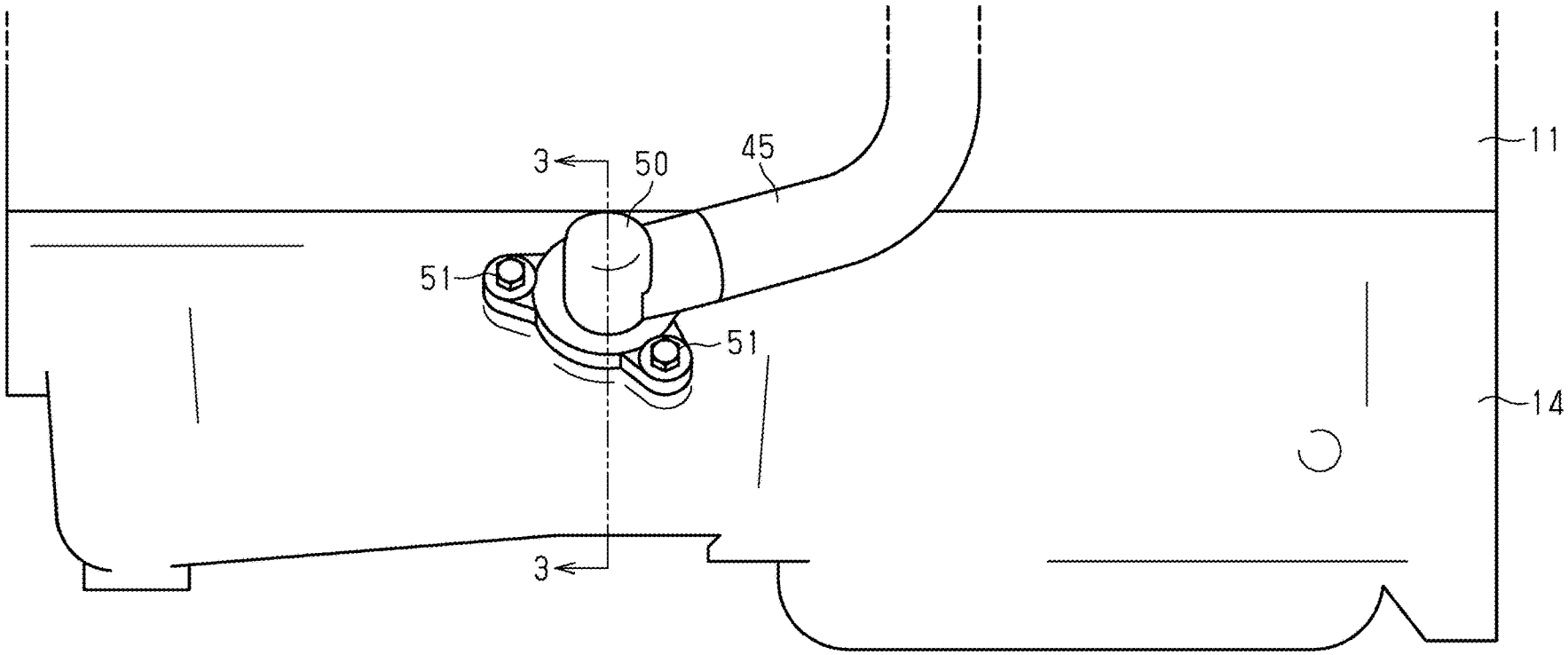
FIG. 2 is a side view of an oil pan of the engine and its periphery.
Figure 3:
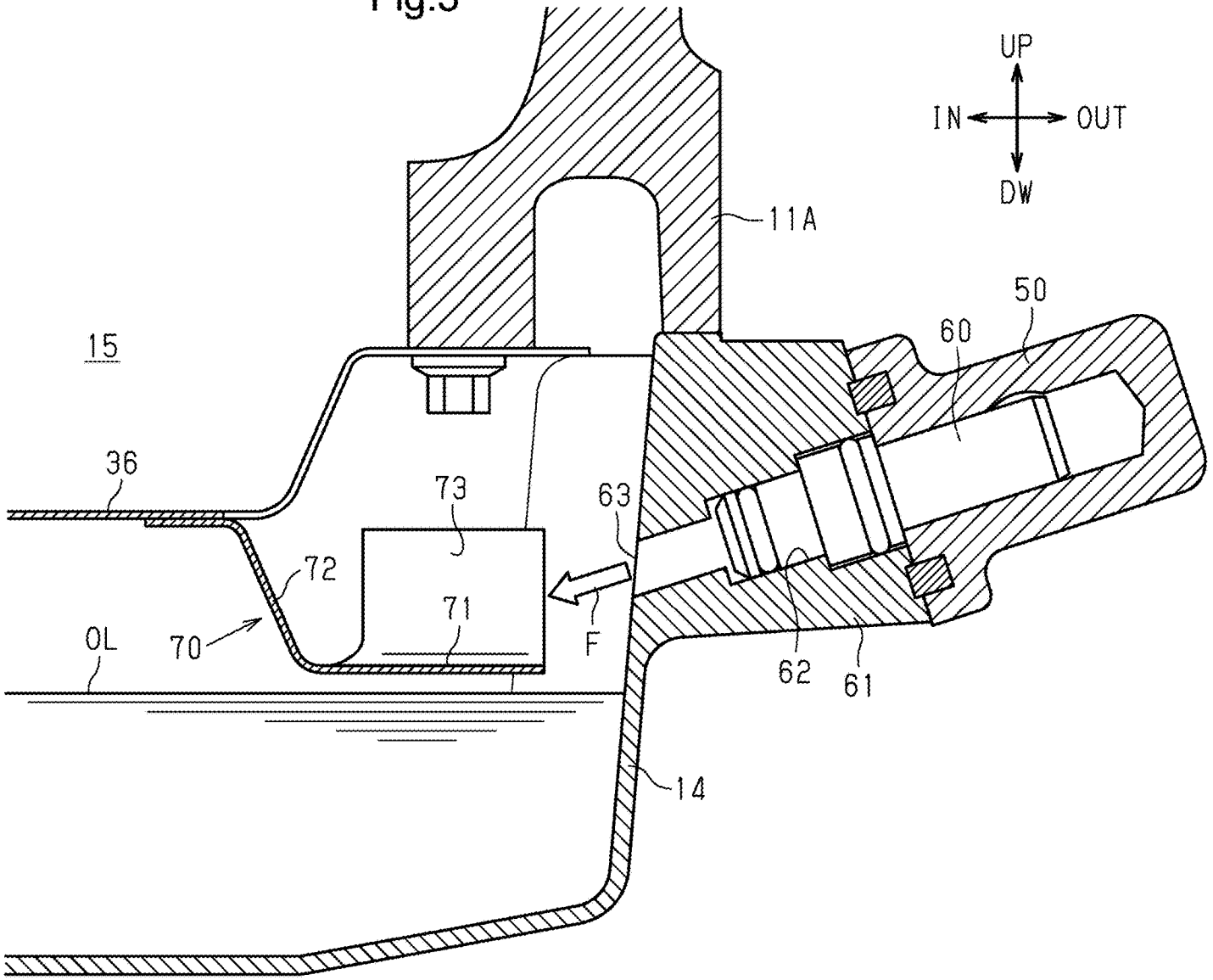
FIG. 3 is a cross-sectional view showing the cross-sectional structure of the engine taken along line 3-3 in FIG. 2.

In the case of the engine 10 of the present embodiment, the one-way valve 60 that restricts the flow direction of the gas in the second passage R2 is directly attached to the crankcase 15. Hereinafter, a structure for attaching the one-way valve 60 to the crankcase 15 will be described with reference to FIGS. 2 and 3. FIG. 2 is a side view of the oil pan 14 of the engine 10 and the vicinity thereof. FIG. 3 shows a cross-sectional structure of the valve housing 50 and its vicinity taken along line 3-3 of FIG. 2.

In the following description, the state of the engine 10 when the vehicle on which the engine 10 is mounted is stationary on a horizontal plane will be referred to as the state of the engine 10 when mounted on the vehicle. In addition, the liquid surface of the engine oil in the crankcase 15 when the engine oil is injected into the engine 10 in an amount corresponding to the upper limit of the appropriate range in the vehicle-mounted state is referred to as a reference oil level OL. Furthermore, in the one-way valve 60, a side on which a discharge port of air to the inside of the crankcase 15 is provided is referred to as a distal end side of the one-way valve 60, and the opposite side is referred to as a proximal end side of the one-way valve 60.

Figure 4:
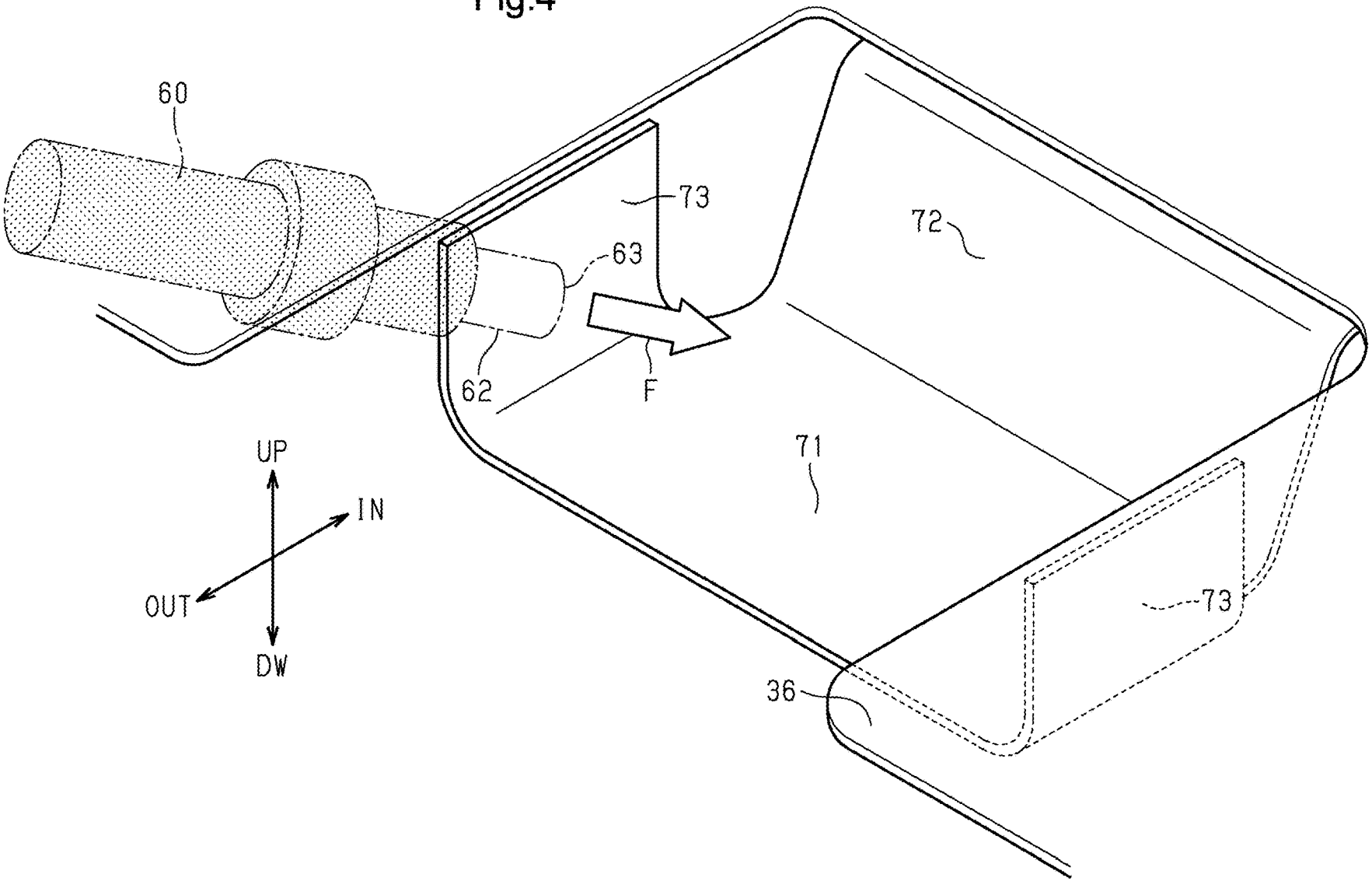
FIG. 4 is a perspective view of a shielding plate arranged in the engine and its periphery.

Further, in FIG. 3 and FIG. 4 described later, respective directions of a mounting upper side UP, a mounting lower side DW, a case inner side IN, and a case outer side OUT are indicated by arrows. The mounting upper side UP and the mounting lower side DW respectively represent a vertically upper side and a vertically lower side when the engine 10 is mounted on the vehicle. A case inside IN indicates a direction from the outside to the inside of the crankcase 15 in the horizontal direction at the time of mounting, and a case outside OUT indicates a direction from the inside to the outside of the crankcase 15 in the horizontal direction at the time of mounting. The horizontal direction at the time of mounting represents a horizontal direction in a cross section shown in FIG. 3 in a state in which the engine 10 is mounted on the vehicle.

As shown in FIG. 2, the engine 10 includes a valve housing 50 for attaching the one-way valve 60 to the crankcase 15. The valve housing 50 is fixed to the outer wall of the oil pan 14 by a bolt 51. In the case of FIG. 2, the valve housing 50 is fixed by two bolts 51. The valve housing 50 may be fixed by one bolt 51 or three or more bolts 51. Further, the valve housing 50 may be fixed to the crankcase 15 by a method other than the bolt 51. The second PCV hose 45 is connected to the crankcase 15 via a valve housing 50.

As shown in FIG. 3, a boss 61 is provided at a portion of the oil pan 14 where the one-way valve 60 and the valve housing 50 are mounted. The boss 61 is formed with an insertion hole 62 that communicates the inside and the outside of the crankcase 15. A distal end portion of the one-way valve 60 is inserted into the insertion hole 62. A base end side portion of the one-way valve 60 protruding from the insertion hole 62 is covered by the valve housing 50. The one-way valve 60 is attached to the crankcase 15 in a state of being sandwiched between the oil pan 14 constituting the outer wall of the crankcase 15 and the valve housing 50.

The one-way valve 60 is attached to the crankcase 15 in a state in which the distal end side of the one-way valve 60 faces obliquely downward. The air discharged from the one-way valve 60 flows into the crankcase 15 without changing its direction. Therefore, the air is discharged from the second passage R2 provided with the one-way valve 60 to the inside of the crankcase 15 in the direction F shown in the drawing. The direction Fis a direction in which the distance from the liquid surface of the engine oil in a state in which the engine 10 is mounted on the vehicle becomes shorter toward the front in the air discharge direction.

The air discharged from the one-way valve 60 flows into the crankcase 15 through the opening 63 of the insertion hole 62 in the inner wall surface of the crankcase 15. Therefore, the opening 63 corresponds to an opening of the second passage R2 inside the crankcase 15. The opening 63 is located on the mounting-time upper side UP with respect to the reference oil level OL and on the mounting-time lower side DW with respect to the baffle plate 36.

Shielding Plate

It is assumed that the air discharged from the opening 63 of the second passage R2 travels straight inside the crankcase 15. In this case, air is blown to the liquid surface, and the engine oil is stirred. The engine 10 of the present embodiment is provided with a shielding plate 70 for suppressing blowing of air to the liquid surface of the engine oil.

Next, the configuration of the shielding plate 70 will be described with reference to FIGS. 3 and 4. FIG. 4 shows a perspective structure of the shielding plate 70 and its periphery. In the case of the engine 10 of the present embodiment, the baffle plate 36 is formed in a shape in which a portion around the opening 63 of the second passage R2 is cut out. The shielding plate 70 is disposed in the cut-out portion. In the case of the engine 10 of the present embodiment, the shielding plate 70 is fixed to the baffle plate 36. That is, the shielding plate 70 is installed in a portion around the opening 63 of the second passage R2 inside the crankcase 15 in a state of being integrated with the baffle plate 36.

The shielding plate 70 includes a substantially rectangular dividing wall 71 disposed substantially parallel to the reference oil level OL. The dividing wall 71 is located upward UP from the reference oil level OL and downward DW from the opening 63 of the second passage R2 in a state in which the engine 10 is mounted on a vehicle. In addition, the shielding plate 70 includes a front wall 72 that extends upwardly from an end of the dividing wall 71 located at the case inner side IN. The shielding plate 70 directly opposes the opening 63. The shielding plate 70 is fixed to the baffle plate 36 at an upper end of the front wall 72. Further, the shielding plate 70 includes two side walls 73. The side walls 73 extend upwardly from two opposite sides of the dividing wall 71, respectively. In the engine 10 of the present embodiment, the two side walls 73 are not continuous with the front wall 72. In other words, a gap is formed between the front wall 72 and each of the side walls 73.

Operation of the Embodiment

The engine 10 of the present embodiment includes the second passage R2 that connects the intake passage 21 and the inside of the crankcase 15. During forced-induction operation, the engine 10 ventilates the crankcase 15 by introducing air from the intake passage 21 through the second passage R2.

The second passage R2 is provided with the one-way valve 60 that restricts a gas flow from the crankcase 15 toward the intake passage 21. In the engine 10 of the present embodiment, the one-way valve 60 is attached to the crankcase 15. The attachment position or attachment orientation of the one-way valve 60 relative to the crankcase 15 is limited due to interference of the one-way valve 60 with peripheral components or the like. As a result, in the engine 10 of the present embodiment, the one-way valve 60 is attached to the crankcase 15 such that the air discharged from the opening 63 of the second passage R2 is directed toward the liquid surface of the engine oil stored in the crankcase 15.

If the air discharged from the opening 63 of the second passage R2 is directly blown onto the liquid surface of the engine oil, an air bubble rate of the engine oil may increase. Further, the amount of the engine oil inside the crankcase 15 may decrease due to atomization of the engine oil. In this respect, the engine 10 of the present embodiment includes the shielding plate 70 set proximate to the opening 63 of the second passage R2 inside the crankcase 15. The shielding plate 70 includes the dividing wall 71 located upward from the reference oil level OL and downward from the opening 63 of the second passage R2. The dividing wall 71 is disposed substantially parallel to the reference oil level OL. In such an engine 10 of the present embodiment, the dividing wall 71 of the shielding plate 70 blocks the flow of the air discharged from the opening 63 of the second passage R2 into the crankcase 15. As a result, the air introduced into the crankcase 15 for ventilation will not be blown onto the liquid surface of the engine oil.

Advantages of the Embodiment

The engine 10 of the present embodiment has the following effects.

(1) The engine 10 of the present embodiment is provided with the shielding plate 70 installed in the portion around the opening 63 of the second passage R2 inside the crankcase 15. The shielding plate 70 has a dividing wall 71 located in a portion above the reference oil level OL and below the opening 63 in the vertical direction DW. As described above, the shielding plate 70 blocks the flow of air from the opening 63 of the second passage R2 toward the liquid surface of the engine oil. Therefore, the agitation of the engine oil due to the ventilation of the crankcase 15 is suppressed.

(2) The shielding plate 70 is provided integrally with the baffle plate 36. Since the shielding plate 70 is assembled to the engine 10 together with the baffle plate 36, an increase in the number of man-hours of assembly work accompanying the additional installation of the shielding plate 70 is suppressed.

(3) The shielding plate 70 includes the front wall 72 which is erected from the dividing wall 71 and directly faces the opening 63 of the second passage R2. Therefore, the flow of the air discharged from the opening 63 can be effectively blocked.

(4) The blowing of the ventilation air to the liquid surface of the engine oil can also be suppressed by devising the position of the opening 63 and the discharge direction of the air from the opening 63. However, in such a case, the attachment position and the attachment posture of the one-way valve 60 are limited. In the case of the engine 10 of the present embodiment, spraying of the engine oil to the liquid surface is suppressed by the shielding plate 70. Therefore, the degree of freedom of the attachment position and the attachment posture of the one-way valve 60 is increased.

(5) The one-way valve 60 is directly attached to the crankcase 15. More specifically, the engine 10 includes a valve housing 50 fixed to an outer wall of the crankcase 15. The one-way valve 60 is attached to the crankcase 15 in a state of being sandwiched between the crankcase 15 and the valve housing 50. In such an engine 10, the one-way valve 60 is warmed by heat received from the crankcase 15. Therefore, the occurrence of emulsion or freezing in the one-way valve 60 due to a low temperature is suppressed.

OTHER EMBODIMENTS

The above embodiment may be modified as described below. The above embodiment and the following modifications can be combined as long as they remain technically consistent with each other.

Shape of Shielding Plate 70

The shape of the shielding plate 70 can be changed as appropriate as long as the shielding plate 70 has the dividing wall 71 located in the portion above the reference oil level OL in the mounting upward direction UP and below the opening 63 in the mounting downward direction DW. For example, the shielding plate 70 may be configured such that the front wall 72 and the side wall 73 have a continuous shape. Further, one or more of the front wall 72 and the two side walls 73 may be omitted.

Installation of Shielding Plate 70

A portion of the baffle plate 36 in the vicinity of the opening 63 may be formed in a shape recessed in the mounting downward direction DW so as to function as the shielding plate 70. Further, the shielding plate 70 may be configured separately from the baffle plate 36. In this case, the shielding plate 70 may be fixed to an inner wall or the like of the crankcase 15.

OTHERS

The attachment structure and the attachment position of the one-way valve 60 may be changed. For example, the one-way valve 60 may be directly attached to the crankcase 15 by screwing or the like without providing the valve housing 50.

The one-way valve 60 may be attached to a portion other than the crankcase 15.

The configuration of the ventilating system of the engine 10 can be appropriately changed as long as the ventilating system includes the second passage R2 provided with the one-way valve 60. For example, when it is not necessary to ventilate the crankcase 15 during the natural aspiration operation, the first passage R1 may be omitted.

The engine 10 is not limited to a hydrogen engine.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. An engine comprising:

an intake passage;

a crankcase accommodating a crankshaft and including an oil pan that stores engine oil;

an air introduction passage connecting the intake passage and an inside of the crankcase; and a shielding plate set proximate to an opening of the air introduction passage to the inside of the crankcase, the shielding plate including a dividing wall that is located upward from a liquid surface of the engine oil and downward from the opening in a state in which the engine is mounted on a vehicle, wherein the engine is configured to perform ventilation of the crankcase by introducing air from the intake passage through the air introduction passage.

2. The engine according to claim 1, wherein a baffle plate is set inside the crankcase between the oil pan and the crankshaft, and the shielding plate is formed integrally with the baffle plate.

3. The engine according to claim 1, wherein the shielding plate includes a front wall that extends upwardly from the dividing wall and directly opposes the opening.

4. The engine according to claim 1, wherein a one-way valve is attached to the crankcase, the one-way valve being configured to restrict a gas flow from the crankcase toward the intake passage in the air introduction passage.

* * * * *